US007160133B2

(12) United States Patent
Karadimas et al.

(10) Patent No.: US 7,160,133 B2
(45) Date of Patent: Jan. 9, 2007

(54) NURSE CALL CONNECTOR SYSTEM AND METHOD

(75) Inventors: Margaret Karadimas, Naperville, IL (US); Andrew Hottel, Bartlett, IL (US); Thomas Pravongviengkham, Sr., Elgin, IL (US)

(73) Assignee: Gencsus, Schenectady, NY (US)

( * ) Notice: Subject to any disclaimer, the term of this patent is extended or adjusted under 35 U.S.C. 154(b) by 0 days.

(21) Appl. No.: 10/930,764

(22) Filed: Sep. 1, 2004

(65) Prior Publication Data

US 2006/0046579 A1 Mar. 2, 2006

(51) Int. Cl.
*H01R 13/627* (2006.01)

(52) U.S. Cl. ..... 439/352; 439/180; 439/358; 439/923

(58) Field of Classification Search ..... 439/680, 439/700, 180, 677, 352, 358, 923
See application file for complete search history.

(56) References Cited

U.S. PATENT DOCUMENTS 4,649,332 A * 3/1987 Bell ..... 320/117
4,669,791 A * 6/1987 Savill ..... 439/34
4,979,914 A * 12/1990 Robbins et al. ..... 439/681
5,584,726 A * 12/1996 Le Gallic et al. ..... 439/573
5,823,813 A * 10/1998 Dye ..... 439/347
6,203,355 B1 * 3/2001 Neblett et al. ..... 439/372
6,371,777 B1 * 4/2002 Rudoy et al. ..... 439/155
6,464,526 B1 * 10/2002 Seufert et al. ..... 439/352
6,568,950 B1 * 5/2003 Rudoy et al. ..... 439/352
6,878,016 B1 * 4/2005 Wulff et al. ..... 439/700
6,910,911 B1 * 6/2005 Mellott et al. ..... 439/358

* cited by examiner

*Primary Examiner*—Michael C. Zarroli
(74) *Attorney, Agent, or Firm*—Baker & Hostetler LLP

(57) ABSTRACT

A system and method for providing an electrical and mechanical connection which includes a housing having a face, an electrical connector mounted to the housing and configured to engage with a second electrical connector, a receiver connected to the housing and encompassing at least part of the electrical connector and bolt housing mounted on a side of the housing opposite the face and aligned with the holes.

17 Claims, 3 Drawing Sheets

NURSE CALL CONNECTOR SYSTEM AND METHOD

FIELD OF THE INVENTION

The present invention relates generally to electrical connectors. More particularly, the present invention relates to an connector system and method connecting an electrical plug and a receptacle.

BACKGROUND OF THE INVENTION

Nurses in hospitals can be very busy and responsible for a large amount of patients at one time. In order to enable nurses to quickly identify particular needs of an individual patient, nurse call and alert systems have been developed. For example, a patient having a problem or needing the attention of a nurse can activate an actuator located in the patient's room and it will indicate to the nurses located at a central nurses station that a patient is requesting assistance. In other systems, electronic medical devices that monitor and/or treat patients can have alarms when patient's vital signs or treatment schedule is outside a predetermined parameter. In such cases, these machines can send a signal to a nurses station alerting the nurse of the problem.

Many of these nurse call systems include cables or wires running from the patient's room to the nurses station and connect to a terminal unit at the nurses station. A connector system and method may be used in order to connect the cable running from the patient's room to the terminal located at the nurses station.

Connector systems often connect a cable with another cable or with a terminal unit by making both an electric and mechanical connection. Desirable features of an electrical connection include positive contact between the electrical portions in each side of the connector in order to provide a reliable electronic connection. Desirable features associated with mechanical connection include a mechanical connection strong enough so that the connectors will not come apart if they are knocked or jostled in everyday use.

In addition, it may be desirable to permit the connectors to separate if a force acting to separate the connecting reaches a predetermined level. Ideally, separation will not damage the connectors, and they can be repeatedly connected and separated. Further, it may be desirable for some electrical connections to mechanically permit the connectors to only come together in certain predetermined attitudes with respect to each other to ensure the proper electrical leads contact corresponding electrical leads in the connection.

Accordingly, it is desirable to provide a system and method for making both an electric and mechanical connection between the cable and the terminal unit that ensures a positive electrical contact and keeps the connectors together so they do not easily come apart during normal jostling or everyday use. Further, in some applications it may desirable to provide a connection that mechanically can only be connected with the connectors approaching each other in a single attitude in order to assure proper electrical leads match up with the corresponding leads on the other side of the connection.

SUMMARY OF THE INVENTION

The foregoing needs are met, to a great extent, by the present invention, wherein in one aspect an apparatus is provided that in some embodiments provides an electrical and mechanical connection between a cable and a terminal unit creating a positive electrical connection. In some embodiments the connection creates a mechanical connection strong enough to avoid the connectors from separating during everyday use. Some embodiments provide an electrical connection that can come together in only one attitude with respect to each other to ensure that the proper electrical leads connect only to corresponding electrical leads on the other side of the connection.

In accordance with one embodiment of the present invention, a mechanical and electrical connector is provided. The connector includes: a housing having a face; an electrical connector mounted to the housing configured to engage with a second electrical connector and when engaged, provide an electrical connection; and a receiver connected to the housing and encompassing at least part of the electrical connector, the receiver defining a key slot configured to cause the second electrical connector to engage the electrical connector at a specific orientation, and the receiver further defining a groove configured to communicate with a corresponding ridge associated with the second electrical connector to hold the second electrical connector in engagement with the electrical connector up to a predetermined level of force exerted on the second electrical connector to pull the second electrical connector away from engaging the electrical connector and resiliently flexing at least one of the ridge and the receiver to allow the ridge to move out of the slot when the force is greater than the predetermined level.

In accordance with another embodiment of the present invention, a mechanical and electrical connector is provided. The connector includes: means for housing; means for establishing an electrical connection mounted to the housing and configured to connect with a second means for establishing an electrical connection; and means for receiving connected to the housing means and encompassing at least part of the means for establishing an electrical connection, the receiving means defining a key slot configured to cause the second electrical connecting means to engage the means for establishing an electrical connector at a specific orientation, and the receiver further defining a groove configured to communicate with a corresponding ridge associated with the second electrical connector to hold the second electrical connector in engagement with the means for providing an electrical connection up to a predetermined level of force exerted on the second electrical connecting means to pull the second means for establishing an electrical connection away from engaging the means for establishing an electrical connection and resiliently flexing at least one of the ridge and the receiving means to allow the ridge to move out of the slot when the force is greater than the predetermined level.

In accordance with another embodiment of the present invention, a method of establishing an electrical and mechanical connection is provided. The method provides: aligning a first electrical connector to a second electrical receiver; inserting an alignment key into an alignment key shaft; flexing at least one of receiver and a ridge while moving the first electrical connector toward the second electrical connector; and electrically connecting the first electrical connector with the second electrical connector.

In accordance with yet another embodiment of the present invention, a system for providing an electrical connection is provided. The system includes: a first connector; a second connector configured to communicate electrically and mechanically with the first connector; wherein the electrical connection is accomplished by a pin contacting an electric lead. The mechanical connection is accomplished by: receivers encompassing one of the first and second electrical connectors and upon the first and second electrical connecter coming in close proximity with each other, a ridge located on the other connector than the connector having the receivers slides across the receivers causing at least one of the ridge and receivers to flex at least until the ridge enters a groove defined by the other connector than the connector having a ridge, and an alignment key located on one of the first and second connector configured to enter an alignment slot located on the other connector than the connector having the alignment key.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
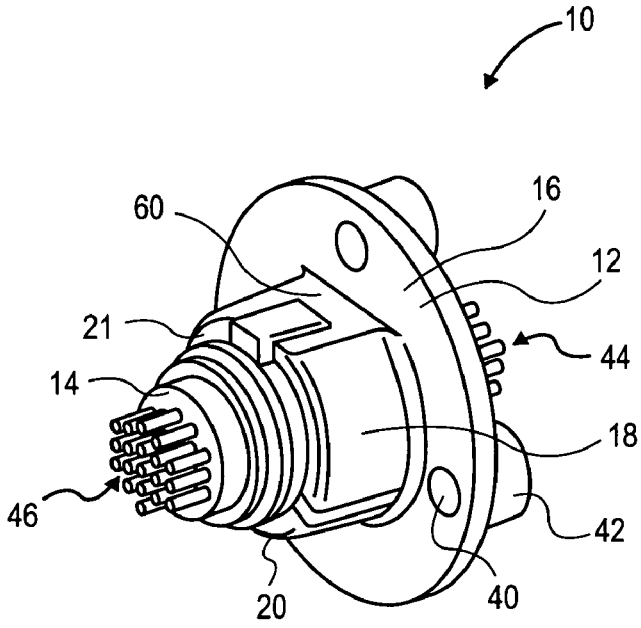
FIG. 1 is a perspective view of a plug connected to a receptacle forming a both mechanical and electrical connection in accordance with a preferred embodiment of the present invention.

The invention will now be described with reference to the drawing figures, in which like reference numerals refer to like parts throughout. An embodiment in accordance with the present invention provides a plug that is configured to both mechanically and electrically connect to a receptacle.

Figure 2:
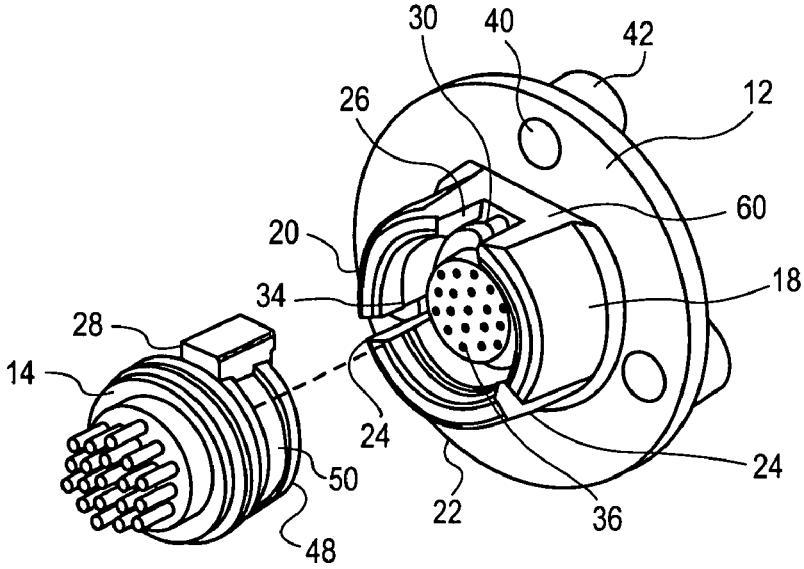
FIG. 2 is a perspective view of the plug approaching the receptacle of FIG. 1.
Figure 3:
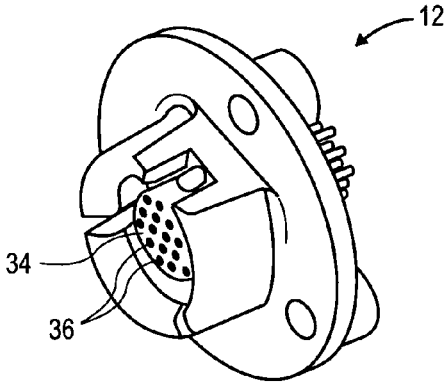
FIG. 3 is a perspective view of a front side the receptacle shown in FIG. 1.
Figure 4:
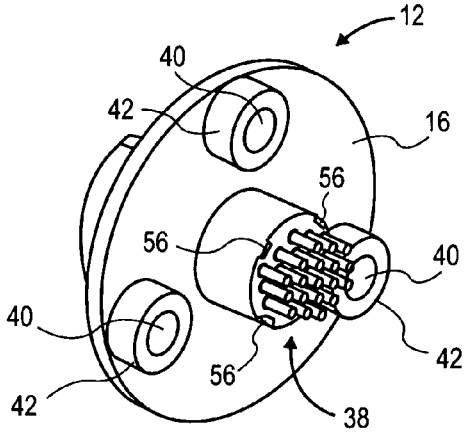
FIG. 4 is a perspective view of the back side of the receptacle shown in FIG. 1.

An embodiment of the present inventive apparatus is illustrated in FIG. 1. FIG. 1 shows a connector system 10. The connector system 10 includes a receptor 12 and a plug 14. The plug 14 is shown inserted into the receptor 12. The receptor 12 includes a housing 16. The housing 16 may be metal or plastic or any other suitable material. As shown in FIG. 2 three receivers 18 are mounted on the housing 16 of the receptor 12. The receivers 18 have a generally circular shape. The receivers 18 are configured to meet with, and receive the plug housing 50.

As shown in FIG. 2, located between the receivers 18 are relief slots 30. A key slot 26 is defined by two of the receivers 18. The key slot 26 is a generally rectangular shape and is configured to receive a corresponding key 32 located on the plug 14. One purpose of the key 32 and key slot 26 is to prevent the plug 14 from entering the receptor 12 at any attitude other than the one with the key 32 fits into the key slot 26. Permitting the plug 14 to only fit in the receptor 12 in one way helps ensure that the electrical contact made between the plug 14 and the receptor 12 is appropriate and the electrical connectors not intended to contact each other do not contact. Inside the key slot 26 is a key hole shaft 58 shown in FIG. 2. The key hole shaft 58 fits into a corresponding hole 56 (see FIG. 5) located within the key 32.

Turning now to FIG. 2, a contact face 28 is located within the area defined by the receivers 18. The contact face 28 has embedded within it contact pads 54. The contact pads contact pins 48 mounted into the plug 14 (see FIG. 5).

The receptor 12 has within the housing 16 bolt holes 40. The bolt holes 40 permit the receptor 12 to be mounted on to a structure such as a terminal structure for a nurse call station. In some embodiments of the invention, self threaded screws will be inserted and turned in the bolt holes 40 to mount the receptor 12 to a terminal housing. Mounted behind the housing 16 are bolt housings 42 which will provide spacing between the housing 16 and the device to which the receptor 12 is mounted.

On the opposite side of the receptor 12 that receives the plug 14, extend printed circuit board contacts 38. In some embodiments the invention, the circuit board contacts 38 may be molded into a plastic housing 16 of the receptor 12.

On the back side of the plug 14 are solder cups 36 which, in some embodiments of the invention, are molded into a plastic housing 50 of the plug 14. The solder cups 36 are electrically connected to wires within a cable that extends to a patient's room in a nurse call system. The plug 14 terminates the cable and permits the cable to be connected to a terminal.

According to some embodiments of the invention, the plug 14 mates with the receptor 12 to form a mechanical connection that resists disconnecting when subjected to a force pulling the plug 14 away from the receptor 12 until the force reaches a predetermined level. Further, once the mechanical connector is broken, it can be reformed and broken again without substantial loss integrity of the connection 10.

Figure 8:
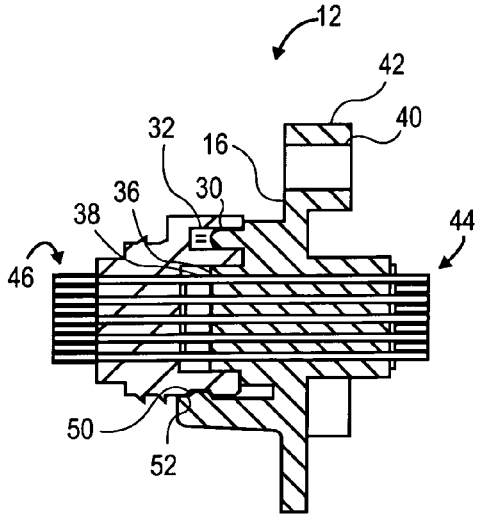
FIG. 8 is a cross section view take along line AA in FIG. 7.
Figure 9:
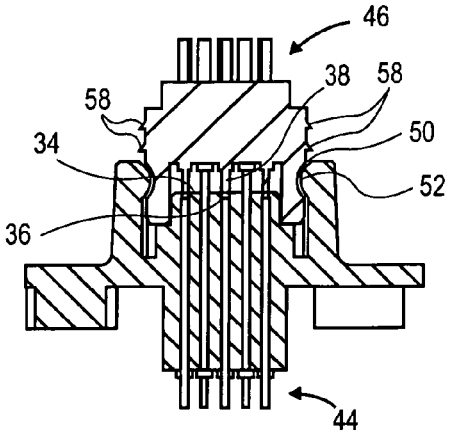
FIG. 9 is a cross section view taken along the line BB in FIG. 7.

In other words, breaking the connection 10 does not normally involve breaking any of the parts of the connectors 12 and 18. For example, a mechanical connection in accordance with the invention can be accomplished by putting a groove 34 into the housing 50 of the plug 14. The groove 34 will contact and connect with a ridge 60 protruding from the receivers 18 as shown in FIGS. 8 and 9. When the plug 14 is inserted into the receptor 12 the housing 50 of the plug 14 will contact the protruding groove 60 and push the receivers 18 and flex them slightly out of the way. To aid in the flexing of the receivers 18 relief slots 30 and 26 are provided. The slots 30 and 26 permit or facilitate the flexing of the receivers 18 and either embodiments of the invention rather than the receivers 18 flexing the plug housing 50 could flex or in some embodiments flexure could occur in both the receivers 18 and the plug housing 50. Once the slot 34 is in place and aligned with the protruding ridge 60, the receivers 18 move back to the original position or near the original position and hold the plug 14 in place as shown in FIGS. 8 and 9.

Figure 5:
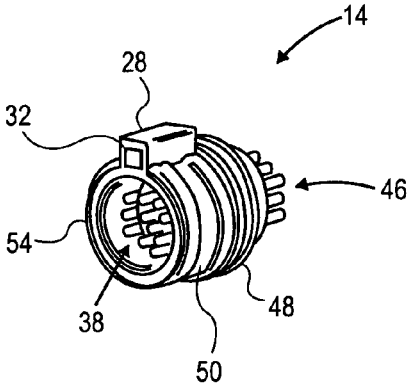
FIG. 5 is a front perspective view of the plug of FIG. 1.
Figure 6:
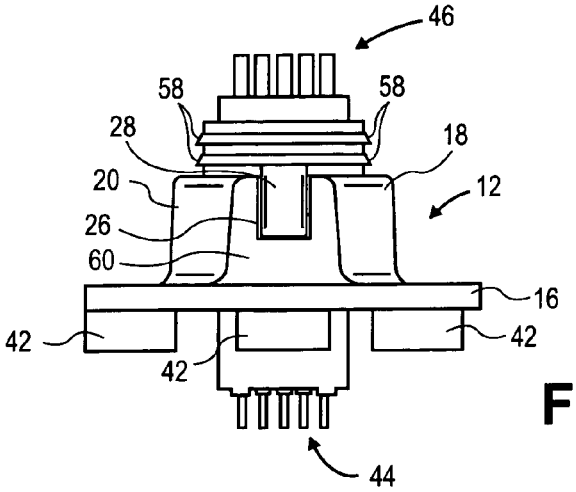
FIG. 6 is a top view of the plug and receptacle of FIG. 1.

According to some embodiments of the invention, the electrical contact between the plug 14 and the receptor 12 is accomplished as follows. As shown in FIG. 5, the plug 14 has pins 48, which in some embodiments of the invention are spring probe pins 48 which are extended in an outmost position by internal springs. The spring probe pins 48 will come in contact with corresponding contacts pads 54 and the spring probe pins 48 will change length slightly as the springs compress due to the close contact with the contact pads 54. In some embodiments of the invention, there are nineteen (19) spring probe pins 48 and nineteen (19) corresponding contact pads 54.

The pins 48 are given protection from an extended portion 46 of the housing 50. The extended portion 46 extends beyond the maximum length of the pins 48 long enough to render the plug 14 scoop proof. The term scoop proof refers to the problem of pins or other fragile elements being damaged by being "scooped" when they are protected by an extension on a housing that provides general protection of the pins. In some instances, the pins can be damaged by an object having a curved surface. (Often another connector having an extended portion of the housing protecting recessed electrical components.) If the two connectors come together in a skewed manner, there is a potential for the extended housing in one connector could contact the pins on the other connector and bend, break, or otherwise damage them. Scoop proofing the connectors done by giving the extended portion of the housing sufficient length that a corresponding connector could not scoop deep enough to contact the pins.

The contact pads 54 are located to be substantially coplanar with the contact face 28. When the plug 14 mates with the receptor 12 the spring probe pins 48 will contact and butt up against the contact pads 54 as shown in FIGS. 8 and 9. The actual physical contact between the spring probe pins 48 and the contact pads 54 provide the electrical connection between the plug 14 and the receptacle 12. The springs in the spring probe pins 48 assist in ensuring the contact with the contact pads 54.

As illustrated in FIGS. 8 and 9 the spring probe pins 48 directly connect through the housing of the plug to the solder cups 36 of the plug 14. Likewise, the contact pads 54 of the receptor 12 directly connect to the printed circuit board connector leads 38. In preferred embodiments of the invention, there is a one to one correspondence between the spring probe pins 48, the contact pads 54, the printed circuit board receptors 38 and the solder cups 36. In the preferred embodiments of the invention there are 19 of each of these elements 48, 54, 38, and 36.

Figure 7:
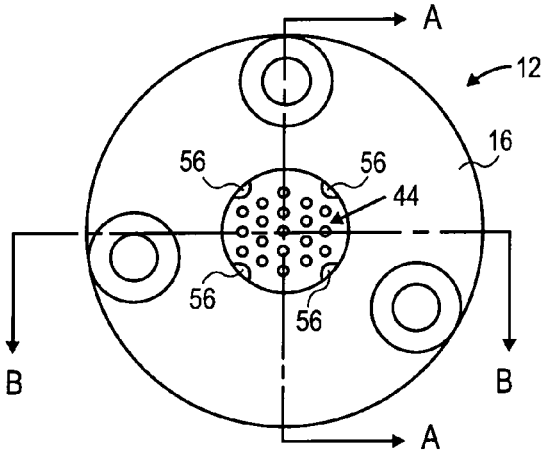
FIG. 7 is a back view of the receptacle of FIG. 1.

In some embodiments of the invention, as shown in FIGS. 7 and 8, the back of the housing 16 has spacers 62 mounted near the printed circuit board leads 38. The spacers 62 permit a gap to exist between the housing 16 and the printed circuit board when the printed circuit board leads 38 are inserted into the printed circuit board.

In some embodiments of the invention, the plug 14 on the plug housing 50 includes grippers 68 as shown in FIGS. 8 and 9. A gripper 68 located on the plug housing 50 and is configured to grip a cable covering that is pushed up and surrounding, at least part, the housing 50. Substantially, in some embodiments of the invention, the receivers 18 substantially form a flat surface 24 on the receptor 12. Further, in some embodiments of the invention, when the key 32 is inserted into the key slot 26, the key 32 helps to define the flat surface 24. In embodiments of the invention where a key hole shaft 58 is configured to fit within the hole 56 in the key 32 the key hole shaft 58 will fit into the key hole 56 and the key 32 as substantially as shown in FIG. 8.

It will be understood that the connectors 14 and 16 and connector systems can be modified from the exemplary embodiment shown and still be in accordance with the invention. For example, features that are shown and described herein as existing on one connector 12 or 14 and having a corresponding feature or the other connector may be reversed as to which connector, the plug 14 or the receptor 12 the feature is located on. Whether the plug 14 or the receptor 12 contains the key, it will be the other connector that contains the key slot 26. Likewise, the key hole shaft 58 and the hole in the key 56 can also be reversed upon which element, the plug 14 or the receptor 12 is found. In addition, the spring probe pins 48 can be carried on the receptor 12, rather than on the plug 14. The protrusion ridge 60 and the corresponding groove 52 can be reversed as to whether they are found on the plug 14 on the receptor 12.

The question of whether the receptor 12 or the plug 14 carries a particular element configured to aid in the mating of the two parts, the plug 14 and the receptor 12, is a design choice that may be made by one skilled in the art after having reviewed this disclosure to meet the specific needs as an individual application.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mechanical and electrical connector comprising:

a housing having a face, flange and mounting holes located in the flange;

an electrical connector mounted to the housing configured to engage with a second electrical connector and when engaged, provide an electrical connection;

a receiver connected to the housing and encompassing at least part of the electrical connector, the receiver defining a key slot configured to cause the second electrical connector to engage the electrical connector at a specific orientation, and the receiver further defining a groove configured to communicate with a corresponding ridge associated with the second electrical connector to hold the second electrical connector in engagement with the electrical connector up to a predetermined level of force exerted on the second electrical connector to pull the second electrical connector away from engaging the electrical connector and resiliently flexing at least one of the ridge and the receiver to allow the ridge to move out of the slot when the force is greater than the predetermined level; and bolt housing mounted on a side of the housing opposite the face and aligned with the holes;

a protrusion connected to the housing and located in the key slot, the protrusion configured to communicate with a corresponding hole in the second connector.

2. The mechanical and electrical connector of claim 1, further comprising a relief slot located in the receiver.

3. The mechanical and electrical connector of claim 2, wherein the key slot is also a relief slot.

4. The mechanical and electrical connector of claim 1, wherein the housing is substantially circular.

5. The mechanical and electrical connector of claim 1, wherein the electrical connection is substantially circular.

6. The mechanical and electrical connector of claim 1, further comprising a plurality of receivers and at least two of the receivers define at least part of the key slot and a flat surface that also defines at least part of the key slot.

7. The mechanical and electrical connector of claim 1, wherein the housing is comprised of plastic.

8. The mechanical and electrical connector of claim 1, wherein the housing and receivers are integral.

9. The mechanical and electrical connector of claim 1, wherein the electrical connection comprises a plurality of spring probe pads and spring probe pins.

10. The mechanical and electrical connector of claim 1, wherein the electrical connection comprises nineteen (19) spring probe pads and nineteen (19) spring probe pins.

11. The mechanical and electrical connector of claim 1, further comprising printed circuit board contacts mounted on the housing in a side opposite the face.

12. A method of establishing an electrical and mechanical connection comprising:

providing a housing have a face, a flange and mounting holes located in the flange on an electrical receiver;

providing bolt housings mounted on a side of the housing opposite the face and aligned with the bolt holes;

aligning an electrical connector to the electrical receiver;

inserting an alignment key into an alignment key shaft;

flexing at least one of receiver and a ridge while moving the electrical connector toward the electrical receiver; and electrically connecting the first electrical connector with the electrical receiver wherein electrically connecting the electrical connecter and receiver includes connecting an equal number of spring probe pins to spring probe pads.

13. The method of claim 12, further comprising sending a nurse call signal through the electrical receiver and connector.

14. The method of claim 12, further comprising flexing at least one of receiver and a ridge while moving the electrical connector away from the electrical receiver.

15. A system for providing an electrical connection comprising:

a first connector;

a second connector configured to communicate electrically and mechanically with the first connector;

wherein the electrical connection is accomplished by a pin contacting an electric lead, and wherein the mechanical connection is accomplished by:

a housing having a face and a flange with mounting holes located in the flange;

receivers encompassing one of the first and second electrical connectors and upon the first and second electrical connecter coming in close proximity with each other, a ridge located on the other connector than the connector having the receivers slides across the receivers causing at least one of the ridge and receivers to flex at least until the ridge enters a groove defined by the other connector than the connector having a ridge, an alignment key located on one of the first and second connector configured to enter an alignment slot located on the other connector than the connector having the alignment key; and bolt housing mounted on a side of the housing opposite the face and aligned with the holes.

16. The system of claim 15, further comprising an alignment projection located on the connector other than the connector having the alignment key, the alignment projection configured to fit into a hole in the alignment key.

17. The system of claim 15, where in the pin is a spring probe pin and the electric lead is a spring probe pad.

* * * * *